United States Patent [19]

Deming

[11] 4,031,021

[45] June 21, 1977

[54] MAGNETIC TONER COMPOSITIONS

[76] Inventor: Philip H. Deming, 5 Orchard Hill, Newtown, Conn. 06470

[22] Filed: Mar. 25, 1974

[21] Appl. No.: 454,270

[52] U.S. Cl. ..... 252/62.1 P; 427/47; 252/62.54; 252/62.56

[51] Int. Cl.[2] ..... G03G 9/08

[58] Field of Search ..... 252/62.1 P, 62.51, 62.53, 252/62.54, 62.55, 62.56; 346/74.1; 427/47

[56] References Cited

UNITED STATES PATENTS

| | | | |
|---|---|---|---|
| 2,874,063 | 2/1959 | Greig | 252/62.53 |
| 3,278,439 | 10/1966 | Blanchette et al. | 252/62.53 |
| 3,345,294 | 10/1967 | Cooper | 252/62.1 P |
| 3,590,000 | 6/1971 | Palermiti | 252/62.1 P |
| 3,627,682 | 12/1971 | Hall et al. | 252/62.53 |
| 3,697,268 | 10/1972 | Ohta | 252/62.1 P |
| 3,773,507 | 11/1973 | Sato et al. | 252/62.1 |
| 3,781,207 | 12/1973 | Tamm | 252/62.1 P |
| 3,819,411 | 6/1974 | Kitamoto et al. | 252/62.51 |
| 3,850,830 | 11/1974 | Fukushima et al. | 252/62.1 |

*Primary Examiner*—David Klein
*Assistant Examiner*—Judson R. Hightower
*Attorney, Agent, or Firm*—Mattern, Ware, Davis & Stoltz

[57] ABSTRACT

A magnetic toner composition for use in decorating a magnetically imaged substrate in magnetic printing machines comprising a particulate blend of between about 50% and about 99% by weight of colored magnetic particles and between about 1% and about 50% by weight of optically innocuous, non-magnetic, frictionally electrifiable particles present as a separate phase of particles substantially non-adhering to the colored magnetic particles.

16 Claims, No Drawings

MAGNETIC TONER COMPOSITIONS

FIELD OF THE INVENTION

Improved magnetic toner compositions for decorating magnetically imaged substrates in magnetic printing devices are achieved by forming particulate blends of conventional toner particles with selected classes of additives. Preferred additives comprise optically innocuous white powder materials having frictional electrostatic or "triboelectric" properties and small powder particle size.

BACKGROUND OF THE INVENTION

Magnetic printing is a newly emerging industry. It consists of forming an image, magnetically, on a magnetizable substrate and decorating that image with a suitable magnetic ink. Suitable inks consist of solid magnetic powders, referred to as toners in this field of application. The magnetic decoration may be viewed as a final text, or, a final text may more economically result from transfer of the decoration from the magnetizable substrate to ordinary paper. The ink in the final text which results from magnetic printing can, owing to pressure, chemical reactions, etc. It is obvious that the text which results from magentic printing can, owing to the magnetic properties of the ink, be read magnetically. Magnetic printing, though, should not be confused with conventional printing using magnetic inks to produce magnetically readable text, as in check identification systems, etc.

Magnetic printing has, conceptually, all the virtues of non-impact printing methods. Text can be produced by compact machines of low maintenance requirements with few moving parts. Magnetic printing has further, conceptually, the virtues of electronic printing methods. Text can be imaged electronically on the magnetic substrate from electronically generated or stored information at speeds appropriate for computer use or telecommunication purposes. Electrostatic analogs of the magnetic approach are in use today but all attempts, until very recently, to use the magnetic approach have failed to achieve a practical result.

Reviews of the literature of non-impact printing methods disclose a rather inconsequential amount of development work on the magnetic method relative to other approaches. It has been suggested that unacceptably high background with poor contrast is a characteristic of the magnetic method. This high level of background has been attributed to electrostatic "noise" generated by frictional electrostatic or "triboelectric" effects in the printing device. In fact, the neutralization of electrostatic effects by providing a conductive path for charge dissipation by the use of a dense bed of conductive toner particles is the main thrust of a recently issued patent. (U.S. patent application, Ser. No. 256,999, now U.S. Pat. No. 3,833,597, filed May 25, 1972, D. W. Ginn et al). Somewhat earlier, the nature of the principal problem in magnetic printing was disclosed (U.S. Pat. No. 3,698,005, issued Oct. 10, 1972 to E. I. Du Pont de Nemours & Co.). That patent states at Column 1, lines 45ff:

> "The basic problem relates to the fact that electrostatic forces are stronger than magnetic forces. Since most magnetic toner particles are attracted by both electrostatic and magnetic fields, any electrostatic fields which are built up on the magnetic recording member will tend to overpower the magnetic field which forms the magnetic image, at least insofar as their effect on the toner particles is concerned, and the background region, i.e., that portion of the magnetic recording member other than that containing the magnetic image, will attract enough toner particles to render any copy unattractive if not unintelligible."

Further information concerning problems with electrostatic effects disclosed in U.S. Pat. No. 3,627,682, issued Dec. 14, 1971 to E. I. DuPont de Nemours & Co: at columns 5 to 7:

> "Conductive carbons such as acetylene blacks or graphite and certain electron donors or acceptors may be used to control electrostatic properties of the toner particles. Stearamide or silicones may be added to promote easy release during the magnetic image transfer to paper. Other modifications to the surface of the toner particles to enhance these properties are well within the state of the art."
>
> "Thus, the buildup of static charges between toner particles and the image-bearing magnetic film can lead to high-toner pickup in background or nonimage areas. This can be controlled by use of conductive recording media and conductive toner particles or carriers; conductive carbon particles, for example, added to the toner help to dissipate the electrical charges."
>
> "If toner particles are smaller than about 1 micron in diameter, they are attracted to surfaces with or without magnetic images and adhere tenaciously by Van der Waal's forces or electrostatic attraction."

In summary, then, it is widely recognized that electrostatic fields create very strong forces whereas forces associated with magnetic fields are relatively weak. One can guess, and there is indication in the literature, that the limited amount of work on the magnetic method is owing to an anticipation of insurmountable levels of electrostatic noise in high speed printing devices. In fact, a heavy level of electrostatic background was an undesirable characteristic of the experimental prototype machines used in connection with the work described here. Much effort was required to get rid of electrostatic charges on toner particles and print surfaces by providing electrically conductive surfaces to the inks and components of the printer suspected of being sources or carriers of electrostatic charge.

SUMMARY OF THE INVENTION

The present invention represents a reversal in direction toward a new solution is pre-magnetized the electrostatic problem in magnetic printing. Rather than attempting to minimize electrostatic charges, particulate blends were prepared, by mixing conventional, substantially homogeneous and uniform opaque colored magnetic toner particles with non-conductive, diamagnetic, frictionally electrifiable white powders of extremely fine particle size. Consistent with the unconventional idea that optically "innocuous" white or light-colored charged particles, able to move independently of magnetic particles, might neutralize some of the electrostatic sites that otherwise would yield undesired background, there was observed an immediate reduction of background and, surprisingly, in some instances, an increase in blackness of copy upon using some particulate blends in the magnetic printing machine.

Particulate blends can be easily and inexpensively prepared. Consequently, as will be described in detail, additional potential sources of background and other properties which affect print quality and toner cost were handled in the same way, by specific selections of optically innocuous non-magnetic frictionally electrifiable materials to be used in particulate blends with colored magnetic particles of black or dark colored hues.

Accordingly, it is a principal object of the present invention to provide magnetic toner compositions for decorating magnetically imaged substrates in magnetic printing devices which significantly reduce electrostatic background and enhance contrast between image decoration and background.

Another object of the invention is to provide such magnetic toner compositions producing reduced image blurring and increased edge sharpness of the decorated image.

Further objects of the invention are to provide such magnetic toner compositions with improved fusing or fixing characteristics, controlled adhesion, cohesion or frictional electrostatic "triboelectric" properties, or controlled rheologic properties.

Other objects of the invention are to provide such magnetic toner compositions with reduced cost, improved lubricity and abrasion characteristics, producing improved feel and texture of fixed decorated copies.

Other and more specific objects will be apparent from the features, elements, combinations and operating procedures disclosed in the following detailed description.

DETAILED DESCRIPTION OF THE INVENTION

Equipment and materials used in developing the present invention consisted of magnetic printing machines produced by Data Interface Incorporated of Danbury, Conn., and commercial and experimental toners from various manufacturers. Toners used were black powdered magnetic solids, fusible in the temperature range of 200° to 400° F for the purpose of fixing the ink by a melting process. Toner particles consisted of iron oxides, and on occasion also iron, carbon black and dyes, which had been worked into a fusible organic matrix and then pulverized by various methods. The particle size range of the toners supplied was generally 3 to 20 microns. Information from toner suppliers indicated also that, on occasion, toner particles had been surface treated to increase their conductivity.

The magnetic printing machines used can be briefly described by means of the following print cycle. A continuous loop of magnetic tape in the unmagnetized state is first magnetized by means of passing the tape over a write-head to form magnetic images (in a 10×12 dot matrix) of a line of characters. The magnetic images are then decorated as fast as formed by passing the tape over a bed of toner. The decorated line is then transferred from the tape to paper by means of pressing the tape against the paper. The paper is advanced therefrom toward a heater to fuse the print. The tape proceeds to an electromagnetic erase head, is also physically wiped clean and thence advances to repeat the print cycle.

The standard print rate in one such machine, model No. DI-240, is three lines per second. Tape velocity in this model, at the point of decoration, is approximately 3 feet per second and contact time with the toner is approximately one one-hundredth of a second. The bulk of the work was done with machines which can generally be described as the DI-240; however, numerous hardware changes were being made in this model concurrent with improvements in toners.

There are intimate relationships, affecting performance of magnetic printing machines, between specific details of the hardware and corresponding specific requirements for physical properties of the toners used. This is particularly true of the required rheological properties of the toner under the operational conditions of viscous drag and shear. These conditions are steep functions of design geometries and velocities, and these conditions substantially affect the relative performance of each of the optically innocuous additives tested. It is not intended that the general utility of such additives be in any way limited by the particular rheological requirements arising from the particular printing machines used.

EXAMPLE I

Initial tests utilized the most successful toner available at that time; an experimental toner, SP No. AA-129, surface treated to improve conductivity and supplied by Surface Processes Corporation but with rheologic properties and conductivity further improved by additions of lampblack. A finely divided (0.05 to 0.06 micron) precipitated calcium carbonate, BASF Wyandotte Purecal$^R$ SC, the surface of which is treated with stearic acid, was selected as an optically innocuous white material which on test readily generated a surface charge on shaking and rapidly responded to electrostatic forces. A physical particulate blend was prepared of 100 parts SP No. AA-129
3 parts lamp black
3 parts Purecal $^R$ SC
106 parts of which 3 parts are optically innocuous.

This mixture was tested under conditions identical to the then best conditions obtaining without the white additive present. Addition of the white additive resulted in a significant reduction in background without loss in blackness of text. Under other conditions, which increase electrostatic background and consequently to a certain degree isolate electrostatic effects from other significant effects, the reduction of background was more pronounced but from a higher initial level.

The magnetic tape normally used has a conductive carbon backing. Using more poorly conductive magnetic tapes, the corresponding more copious background was significantly suppressed by means of the white additive. Replacement of the conductive backing underlying the paper with a non-conductive backing causes a blurring of print and increases background at low humidity. Addition of Purecal$^R$ SC controls the blurring of print.

Control of background at low humidity, particularly with poor papers, was not achieved with conventional toners. This condition is ascribed to electrostatic effects. Purecal$^R$ SC also alleviates this problem, and utilizing particulate blends, described later, operations at low humidity were successful even with poor papers at a relative humidity as low as 5%.

Thus electrostatic problems are evident at different locations in the printing machine, and enhancement of the triboelectric properties of the toner composition reduced background, rather than increased background, when this enhancement was done by blending into the opaque, colored magnetic particles small amounts of a selected optically innocuous fine powder.

This result initiated a general review of the potential utility of white powders. White solids are characteristically non-electron conducting, and had been viewed as increasing electrostatic problems rather than reducing such problems. Theory suggests that their true action in a magnetic printing system arises from an attenuation of undesired electrostatic forces on colored magnetic particles by a more rapid movement of the charge separations that exist in the optically innocuous powders under dynamical conditions.

In accord with this theory, the correct formulating parameter resides in maximizing to the degree that is necessary, primarily by operating on charge mass ratios, the electrostatic magnetic differentiation between optically innocuous particles and ink particles. Under these optimum conditions, white additives do not create visible, objectionable electrostatic background. Consequently, in the limiting case, all of the desired properties for the toner can be formulated into a colorless, non-adherent, non-magnetic phase, keeping only the colored property for the magnetic phase. In addition to observable decoration of the magnetic image, the primary properties desired for a magnetic toner are control of triboelectric phenomena, control of all sources of contact adhesion and cohesion, facilitating the fixing of the ink, and, to the degree that printer hardware requires it, control of the rheologic properties of the ink under conditions of mixing and attrition. Minor properties concern control of abrasion, lubricity, copy texture and feel, etc. An overall constraint requires that materials be inexpensive and biochemically harmless.

A triboelectric enhancement with reduction of background was demonstrated with another BASF Wyandotte precipitated calcium carbonate, Purecal T, showing that a surface treatment with stearic acid was unnecessary. Other powdered salts were tested: tricalcium phosphate, sodium phosphate, micronized sodium chloride, and zinc stearate. In varying degree, these salts gave similar indications with the standard toner. Smallest particle sized white powders, in general, gave better results.

Of a number of hydrous and anhydrous commercial silicas tested, two worked well; Syloid 266, sold by Davison Chemical Division of W. R. Grace, with a number of different conventional toners, and Silicron G-100, sold by Glidden-Durkee Division of SCM Corp., with some but not all of the same toners. Cab-O-Sil, sold by Cabot Corporation, a finely divided silica widely used as a flow assisting agent, in combination with the standard toner SP No. AA-129 increased the background. A hydrous alumina, Hydral 710S, sold by Aluminum Company of America, was particularly effective with toners from one supplier only. A titania tested, Zopaque-R-39, sold by Glidden-Durkee Division of SCM Corp., was not effective by itself. More complex compounds, such as Attagel 50, sold by Engelhard Minerals & Chemicals Division, a clay, and Thermoglace H, sold by Burgess Pigment Company, are also effective.

White organic powders as additives likewise give triboelectric enhancement with electrostatic background reduction. Micronized polyethylene, "Bareco" Polywax 2000, sold by Bareco Division, Petrolite Corp.; polyvinyl ether, maleic anhydride copolymer, Gantrez AN-119, sold by G.A.F. Corp.; B. F. Goodrich Carbopol 934 carboxy vinyl polymers, and a pulverized cellulose, sold by Brown Company, all had the effect of reducing background. One successful toner composition comprised only a mixture of infusible iron oxide particles and a finely powdered fusible terpene derivative polymer, "B-85" manufactured by the Arizona Chemical Company. In the case of the pulverized cellulose, presumably the fines contributed a disproportionate share of the triboelectric enhancement.

The foregoing illustrates the general behavior of non-conductive optically innocuous additives where each additive is added in a fixed small concentration, 1% to 3%, to each colored, opaque toner. Under these conditions, a variety of binary combinations of additives and toners fail to show the desired effect. This can be understood since triboelectric effects and other properties depend, not just on the properties of the additives, but on the mutual surface interactions and phase behavior of both the additives and the toners. Small amounts (0.05% to 1.5%) of a few of these additives have been used as flow assisting agents in a wide variety of applications. They function to break up interparticle adhesion by partially coating and intervening in interparticle contact of the granular solids whose flow is to be assisted.

The minimum quantities required to produce triboelectric enhancement with background reduction depend on these detailed interactions of interparticle adhesion. A detailed understanding of these very complex surface interactions is not necessary, though, for successful formulation of particulate blends of toners and additives following the disclosures presented herein. Precipitated calcium carbonate seems to be quite generally effective, presumably owing to a combination of high triboelectric properties, very small particle size and the physicochemical inertness of its surface relative to contact adhesion. Ternary and more complex blends are advantageous and also contribute a range of other desirable properties to the toner composition. These other properties mainly concern the appropriate rheologic properties for specific printer designs, appropriate surface conditioning for specific magnetic tapes used, and appropriate lubricity for specific drive mechanisms and copy texture.

EXAMPLE II

As an example of such other desirable properties, the use of particulate blends of optically innocuous frictionally electrifiable materials is advantageous for incorporating material into magnetic inks for the purpose of fixing the inks. This has been demonstrated by utilizing a physical particulate blend of 30 weight percent impalpable zinc stearate M (Witco Chemical Company), softening point 119° C, and 70 weight percent of infusible black iron oxide (BK-5099, Pfizer Minerals Pigments and Metals Division). While the flow properties of this toner composition were poor for the machine used for the test, it can be made to print by adjustments in machine geometry and produced text which was fixed by fusion over the heater. Fusible iron distearate powders (non-magnetic and light tan in color) perform similarly. The black iron oxide used in these examples has an extremely fine particle size and it is preferred to increase its operationally effective particle size by pre-magnetizing the mixture. Magnetic forces then agglomerate the oxide powders into cohesive clusters or groups.

EXAMPLE III

A further example of incorporating optically innocuous substances in particulate blends for the purpose of fixing infusible colored magnetic materials is striking in its economical simplicity for use in the No. DI-240 machine. A particulate blend of 82% BN-4498 (Pfizer Mineral Pigments and Metals Division), 12% impalpable zinc stearate M, and 6% aluminum octoate (Witco Chemical Co.) yields fixed copy with high contrast. BN-4498, a finely ground naturally occurring magnetite has a larger particle size than the black iron oxide BK-5099 of Example II, which is a synthetic precipitated iron oxide. Consequently the magnetic-electrostatic differentiation in this Example III blend is high and a very low background results. The overall particle size and particle size distribution of the blend is appropriate for good flow in the DI-240. Enough zinc stearate and aluminum octoate is entrapped by the iron oxide powder to enable the copy to be fixed. The fixed copy is tough owing to a combination of melting and chemical reactions which result from the white additives. The zinc stearate melts and the infusible aluminum octoate dissolves in and by virtue of chemical exchange reactions gels the melt and binds the iron oxide particles together. The resulting cooled copy consists of iron oxide and resolidified zinc stearate reinforced by a gel structure. The technique disclosed by this example can be extended to a wide variety of chemical reactions; esterification, transesterification, polyurethane formation, epoxy curing reactions and the like to produce tough coatings.

It can thus be seen from the foregoing that each additive modifies a number of the properties of a given toner composition. Zinc stearate, as an example, enhances the triboelectric properties of the toner. It also incorporates a fusible solid into the toner. It prevents an irreversible compaction on compression for some toners. It increases the lubricity of the toner. It substantially changes the flow properties of the toner (adversely at large concentrations for the printing machine used).

One cannot separate quantitatively, for any given formulation and any given machine, the impact of all these changes in toner properties on toner performance. The triboelectric effect itself is also subject to alternative or additional theoretical explanations. While rapid motions of charge separations may reduce electric fields and neutralize some charged sites that would otherwise appear as background, it may also be true that higher charge separations finally remain internally in the toner and contribute to it a cohesive quality that reduces background. It has been demonstrated, for example, that an imaged decorated tape can be magnetically erased without losing the decoration even when the tape undergoes rapid deceleration. Electrostatic forces may be responsible for holding such decorations together.

Additionally, charge separations may give the toner a structure which inhibits the transfer of background during the decoration step. Cohesive forces from residual charge separations will contribute to poor flow of the toner under static conditions. Successful toners have typically a high angle of repose and do not flow readily. Nonetheless, under shear, they have high fluidity. The triboelectric enhancement appears to have enhanced the thixotropic properties of the toner. In view of all these posssibilities, one would not wish to insist upon any single theory concerning maximum toner performance.

The following provides an example of a toner composition which works well in the DI-240 and in which a combination of optically innocuous additives are used to produce an overall balance of properties. All "parts" are measured by weight in all examples herein.

EXAMPLE IV

| | |
|---|---|
| 100 | parts PD-5-59 toner (Nashua Corporation) |
| 2 | parts lampblack |
| 3 | parts Syloid 266 |
| 1.5 | parts Zinc Stearate |
| 1.5 | parts Titania |
| 1.5 | parts Purecal T |
| 109.5 | parts, of which 9.5 parts are optically innocuous |

In the foregoing example the magnetic material is first pre-magnetized and then blended with the additives.

Another example uses also additional techniques which have been disclosed herein and results in a toner composition which has better durability in high speed machines and provides improved copy texture.

EXAMPLE V

| | |
|---|---|
| 100 | parts PD-5-59 (Nashua Corporation) |
| 30 | parts BK-5099 (iron oxide) |
| | blend, pre-magnetize and then blend thoroughly with |
| 2 | parts iron distearate |
| 3 | parts Syloid 266 |
| | then blend briefly with |
| 3 | parts Purecal T |
| 2 | parts Carbopol 934 (B. F. Goodrich Co.) |
| 1 | part Hydral 710S (ALCOA) |
| 141 | parts of which 11 parts are optically innocuous |

Between about 1% and about 50% by weight of optically innocuous powder has proved effective, and it is apparent from the foregoing examples that amounts between about 3 and about 20, weight percent of optically innocuous powder particles produce excellent results.

A wide variety of alternative formulations have been devised which perform well but have not been subjected to long term tests. Still further modifications and alternative implementations of the invention will occur to those skilled in the art without departing from the scope of the invention. Accordingly, it is not intended to limit the invention by the examples given, theories presented and procedures described except as indicated in the appended claims.

It will thus be seen that the objects set forth above, among those made apparent from the preceding description, are efficiently attained and, since certain changes may be made in the above composition of matter without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A magnetic toner composition for use in decorating a magnetically imaged substrate in magnetic printing machines for transfer to a reading medium comprising a particulate blend of A. between about 50% and about 99% by weight of magnetic particles having a contrasting color with respect to the color of said reading medium and B. between about 1% and about 50% by weight of non-magnetic, frictionally electrifiable particles in a concentration sufficient to physically adhere to the magnetic particles and to be also present as a separate phase of particles substantially non-adhering to the magnetic particles and having a color non-contrasting with the color of said reading medium.

2. A toner composition according to claim 1 wherein the non-magnetic particles consist at least on part of finely divided salts.

3. A toner composition according to claim 1 wherein the non-magnetic particles consist at least in part of finely divided oxides.

4. A toner composition according to claim 1, wherein the non-magnetic particles consist at least in part of finely divided organic solids.

5. A toner composition according to claim 1, wherein the non-magnetic particles consist at least in part of finely divided solids readily fusible at temperatures below 400° F.

6. A toner composition according to claim 1, wherein the non-magnetic particles consist at least in part of finely divided, readily fusible solids and the magnetic particles consist at least in part of infusible magnetic solids.

7. A magnetic toner composition according to claim 1 wherein the toner composition is pre-magnetized or magnetized in situ in a toner reservoir chamber in the printing machine prior to its application to a magnetic substrate to decorate a magnetic image thereon.

8. A magnetic toner composition according to claim 1 wherein the non-magnetic non-adhering particles have particle mass less than one-tenth of the heavier of the magnetic particles themselves and of any agglomerated clusters of said magnetic particles.

9. A toner composition according to claim 8, wherein the non-magnetic particles consist at least in part of finely divided, readily fusible solids and the magnetic particles consist at least in part of infusible magnetic particles.

10. A toner composition according to claim 8 wherein the toner composition ispre-magnetized or magnetized in situ in a toner reservoir chamber in the printing machine.

11. A magnetic toner composition for use in decorating a magnetically imaged substrate in magnetic printing machines for transfer to a reading medium consisting essentially of a particulate blend of magnetic particles having a contrasting color with respect to the color of said reading medium and consisting at least in part of infusible magnetic particles; and non-magnetic, finely divided readily fusible solid particles having a color non-contrasting with the color of said reading medium and present in a concentration sufficient to physically adhere to the magnetic particles and also present as a separate phase of particles substantially non-adhering to the magnetic particles.

12. The magnetic toner composition defined in claim 11 wherein the infusible magnetic particles consist essentially of iron oxide.

13. The magnetic toner composition defined in claim 11 wherein the major part of the non-magnetic fusible solid particles consist of zinc stearate.

14. The magnetic toner composition defined in claim 13 wherein the infusible magnetic particles comprise between about 80 weight percent and about 90 weight percent of iron oxide, while the non-magnetic readily fusible solid particles comprise between about 10 weight percent and about 20 weight percent of zinc stearate.

15. The method of decorating a magnetically imaged substrate in a printing machine for transfer to a reading medium which comprises the step of decorating a magnetically imaged substrate with a magnetic toner composition comprising a particulate blend of:

A. between about 50% and about 99% by weight of magnetic particles having a contrasting color with respect to the color of the reading medium, and B. between about 1% and about 50% by weight of non-magnetic, frictionally electrifiable particles present in a concentration sufficient to physically adhere to the magnetic particles and also present as a separate phase of particles substantially non-adhering to the magnetic particles and having a color non-contrasting with the color of said reading medium.

16. A composition for decorating a magnetically imaged substrate in a printing machine for transfer to a reading medium comprising a particulate blend of:

A. between about 50% and about 99% by weight of magnetic particles having a contrasting color with respect to the color of the reading medium; and B. between about 1% and about 50% by weight of non-magnetic, frictionally electrifiable particles present in a concentration sufficient to physically adhere to the magnetic particles and also present as a separate phase of particles substantially non-adhering to the magnetic particles and having a color non-contrasting with the color of said reading medium.

* * * * *

UNITED STATES PATENT AND TRADEMARK OFFICE

CERTIFICATE OF CORRECTION

PATENT NO. : 4,031,021

DATED : June 21, 1977

INVENTOR(S) : Philip H. Deming

It is certified that error appears in the above-identified patent and that said Letters Patent are hereby corrected as shown below:

| | | |
|---|---|---|
| Column 1, Line 24 | - | after "text" cancel "which results from magnetic printing can, owing to" and substitute --may be further fixed by action of heat, solvents,-- |
| Column 2, line 52 | - | after"solution" cancel "is pre-magnetized" and substitute --of-- |
| Column 5, line 37 | - | add " R " after "Purecal" |
| Column 5, line 68 | - | add " R " after"Gantrez" |
| Column 9, line 48 | - | cancel "ispre-magnetized" and substitute --is pre-magnetized-- |

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*